US007828263B2

(12) United States Patent
Bennett et al.

(10) Patent No.: US 7,828,263 B2
(45) Date of Patent: Nov. 9, 2010

(54) CONCRETE FORM BRACE AND BATTERING WEDGE

(75) Inventors: Clifford D. Bennett, Alta Loma, CA (US); Kenneth Lee, Anaheim, CA (US)

(73) Assignee: Dayton Superior Corporation, Miamisburg, OH (US)

( * ) Notice: Subject to any disclaimer, the term of this patent is extended or adjusted under 35 U.S.C. 154(b) by 310 days.

(21) Appl. No.: 10/897,243

(22) Filed: Jul. 22, 2004

(65) Prior Publication Data

US 2006/0016956 A1 Jan. 26, 2006

(51) Int. Cl.
*E04G 17/14* (2006.01)

(52) U.S. Cl. ..... 249/219.1; 249/2

(58) Field of Classification Search ..... 249/2, 249/3, 208, 139, 164, 219.1; 248/247, 248, 248/235, 300, 351, 441.1; D8/380, 381, D8/373, 71, 499; 269/122, 909
See application file for complete search history.

(56) References Cited

U.S. PATENT DOCUMENTS

| | | | | | |
|---|---|---|---|---|---|
| 541,114 | A | * | 6/1895 | Kaiser | 248/235 |
| 844,494 | A | * | 2/1907 | Best | 248/300 |
| 934,414 | A | * | 9/1909 | Moran | 248/248 |
| 939,005 | A | | 11/1909 | Goedeke | |
| 1,349,340 | A | | 8/1920 | Hotchkiss | 249/3 |
| 1,374,894 | A | | 4/1921 | Ambursen | 52/712 |
| 1,512,165 | A | | 10/1924 | Funkhouser | 249/6 |
| 1,527,698 | A | | 2/1925 | Pearthree | 249/7 |
| 1,682,008 | A | | 8/1928 | Heltzel | |
| 1,690,295 | A | | 11/1928 | Heltzel | 249/6 |
| 1,722,144 | A | | 7/1929 | Heltzel | 249/6 |
| 1,944,511 | A | | 1/1934 | Heltzel | 249/6 |
| 2,063,748 | A | | 12/1936 | Olsen | |
| 2,313,880 | A | | 3/1943 | Leggett | 249/27 |

(Continued)

FOREIGN PATENT DOCUMENTS

DE 3129838 2/1983

(Continued)

OTHER PUBLICATIONS

Maltry Theodor H (DE), *English Abstract of Shuttering Element for Reinforced-Concrete Structures*, Patent No. DE3129838, esp@cenet database, Published Feb. 17, 1983 (1 page).

(Continued)

*Primary Examiner*—Michael Safavi
(74) *Attorney, Agent, or Firm*—Thompson Hine LLP

(57) ABSTRACT

A brace for securing concrete forms to a base has first and second triangularly-shaped sidewalls and a back wall extending between corresponding side edges of the sidewalls. A peripheral flange extends outwardly from the side edges of the sidewalls and the ends of the back wall and has apertures for facilitating fastening of the brace to the concrete forms and a casting surface. Advantageously, the brace can be formed as a unitary, molded component. A battering wedge is selectively attachable to the side edges of the sidewalls and cooperates with the brace to facilitate tilting the concrete form at an angle to the casting surface. The battering wedge is selectively frangible to permit use with braces of varying size.

12 Claims, 3 Drawing Sheets

U.S. PATENT DOCUMENTS

| | | | | | |
|---|---|---|---|---|---|
| 2,678,482 | A | * | 5/1954 | Cuthbertson et al. | 249/4 |
| 2,727,712 | A | | 12/1955 | Holmboe | |
| 2,738,563 | A | | 3/1956 | George | 249/195 |
| 2,772,468 | A | * | 12/1956 | Heltzel | 249/3 |
| 2,875,500 | A | | 3/1959 | Stough | 25/118 |
| 2,891,759 | A | | 6/1959 | Holmboe | |
| 2,917,803 | A | | 12/1959 | Phillips | 249/6 |
| 2,991,532 | A | | 7/1961 | Stiles | 25/118 |
| 2,994,905 | A | | 8/1961 | Franker, Jr. | |
| 3,202,393 | A | | 8/1965 | Pettit | 249/2 |
| 3,296,749 | A | * | 1/1967 | Cotter | 52/11 |
| 3,400,847 | A | | 9/1968 | Stute | 217/69 |
| 3,428,287 | A | | 2/1969 | Redding et al. | 249/13 |
| 3,444,659 | A | | 5/1969 | Shanni | 52/149 |
| 3,582,035 | A | | 6/1971 | Wells et al. | 249/18 |
| 3,584,826 | A | | 6/1971 | Liester | 249/35 |
| 3,606,229 | A | * | 9/1971 | Nolan | 248/235 |
| 3,609,935 | A | | 10/1971 | Thomas | 52/745 |
| RE27,258 | E | * | 12/1971 | Yunker et al. | 114/287 |
| 3,632,078 | A | | 1/1972 | Dashew | 249/183 |
| 3,637,181 | A | | 1/1972 | Janssen | 248/205 |
| 3,681,882 | A | | 8/1972 | Bettinger | 52/126 |
| 3,700,202 | A | | 10/1972 | Donnels | 248/354 |
| 3,743,286 | A | | 7/1973 | Weinhagen et al. | |
| 3,775,240 | A | | 11/1973 | Harvey | 161/149 |
| 3,797,800 | A | | 3/1974 | Loy | 249/13 |
| 3,817,006 | A | | 6/1974 | Williams | |
| 3,837,605 | A | * | 9/1974 | Sicard | 248/235 |
| 3,848,844 | A | * | 11/1974 | Barrett | 248/245 |
| 3,922,135 | A | | 11/1975 | Haller et al. | 425/432 |
| 3,979,093 | A | | 9/1976 | Madden | 248/56 |
| 4,042,205 | A | | 8/1977 | Herrell | 249/189 |
| 4,068,427 | A | | 1/1978 | Camardo | |
| 4,083,156 | A | | 4/1978 | Tye | 52/127 |
| 4,101,111 | A | | 7/1978 | Bishop | 249/205 |
| 4,103,855 | A | * | 8/1978 | Grosse | 248/246 |
| 4,104,356 | A | | 8/1978 | Deutsch et al. | 264/297 |
| 4,123,882 | A | | 11/1978 | Case et al. | 52/125 |
| 4,124,907 | A | | 11/1978 | Laven | 52/169.7 |
| 4,156,515 | A | * | 5/1979 | Mochly | 248/246 |
| 4,223,863 | A | * | 9/1980 | Birman | 248/246 |
| D260,852 | S | * | 9/1981 | Loeschen | D8/381 |
| 4,290,985 | A | | 9/1981 | Barale | 264/31 |
| 4,299,368 | A | * | 11/1981 | Winkler | 248/246 |
| 4,339,106 | A | | 7/1982 | Navarro | 249/219 |
| D266,482 | S | * | 10/1982 | Goldstein | D8/381 |
| 4,389,831 | A | | 6/1983 | Baumann | 52/741 |
| 4,393,568 | A | | 7/1983 | Navarro | 29/432 |
| 4,464,802 | A | | 8/1984 | Glonek et al. | 4/506 |
| 4,542,613 | A | | 9/1985 | Leyte-Vidal | 52/375 |
| 4,553,751 | A | | 11/1985 | Ketchum | |
| 4,576,664 | A | | 3/1986 | Delahunty | 156/71 |
| 4,659,057 | A | | 4/1987 | Felter | 249/97 |
| 4,695,211 | A | | 9/1987 | Van Iperen et al. | 410/77 |
| 4,720,069 | A | * | 1/1988 | Bessinger | 248/250 |
| 4,724,968 | A | | 2/1988 | Wombacher | 211/59.3 |
| 4,762,081 | A | * | 8/1988 | Porter | 248/235 |
| 4,779,830 | A | * | 10/1988 | Phelps | 248/250 |
| 4,841,702 | A | | 6/1989 | Huettemann | 52/309.12 |
| 4,846,437 | A | | 7/1989 | Fitzgerald | 249/3 |
| D310,165 | S | * | 8/1990 | Cobb | D8/381 |
| D312,962 | S | * | 12/1990 | Overton | D8/381 |
| 4,996,770 | A | | 3/1991 | McCracken | 29/897.34 |
| 5,076,079 | A | | 12/1991 | Monoson et al. | 70/58 |
| 5,076,536 | A | | 12/1991 | Fitzgerald | 249/219.1 |
| 5,096,155 | A | | 3/1992 | Fitzgerald | 249/219.1 |
| D331,873 | S | * | 12/1992 | Finkelstein et al. | D8/381 |
| 5,205,942 | A | | 4/1993 | Fitzgerald | 249/3 |
| 5,212,920 | A | | 5/1993 | Tye | 52/127.1 |
| 5,226,265 | A | | 7/1993 | Kelly et al. | 52/125.6 |
| 5,377,447 | A | | 1/1995 | Fritch | 47/33 |
| 5,489,468 | A | | 2/1996 | Davidson | 428/261 |
| 5,491,948 | A | | 2/1996 | Harris | 52/596 |
| 5,656,194 | A | | 8/1997 | Zimmerman | 249/160 |
| 5,662,305 | A | | 9/1997 | Shimamura et al. | 248/500 |
| 5,667,190 | A | | 9/1997 | Scott et al. | 249/16 |
| D384,879 | S | * | 10/1997 | Carlson | D8/381 |
| 5,692,722 | A | | 12/1997 | Lundag.ang.rds | 248/553 |
| 5,695,165 | A | | 12/1997 | Moriarty | 248/316.8 |
| 5,702,627 | A | | 12/1997 | Brasken | 249/33 |
| 5,732,918 | A | * | 3/1998 | Steele et al. | 248/300 |
| D393,416 | S | * | 4/1998 | Tisbo | D8/381 |
| 5,766,645 | A | * | 6/1998 | Kaminski | 249/139 |
| 5,771,643 | A | | 6/1998 | Parker | 52/169.5 |
| 5,817,247 | A | | 10/1998 | Colatruglio | 249/4 |
| 5,843,327 | A | | 12/1998 | Lindgren | 249/210 |
| 5,897,816 | A | | 4/1999 | Johnson | 264/35 |
| 6,067,757 | A | | 5/2000 | Olson et al. | 52/125.1 |
| 6,073,405 | A | | 6/2000 | Kasai et al. | 52/283 |
| 6,182,416 | B1 | | 2/2001 | Brackin | 52/745.09 |
| 6,186,469 | B1 | | 2/2001 | Scott | 249/16 |
| 6,195,956 | B1 | | 3/2001 | Reyneveld | 52/745.19 |
| 6,230,451 | B1 | | 5/2001 | Stoller | 52/169.1 |
| D443,810 | S | * | 6/2001 | Ausilio | D8/354 |
| 6,352,237 | B1 | | 3/2002 | Severino | 249/194 |
| D455,066 | S | * | 4/2002 | Kolinen | D8/373 |
| 6,412,745 | B1 | | 7/2002 | Yokoyama et al. | 248/500 |
| 6,439,561 | B1 | * | 8/2002 | Ausilio | 269/47 |
| 6,540,201 | B1 | | 4/2003 | Gagnon et al. | 249/139 |
| 6,698,702 | B2 | | 3/2004 | Macri et al. | |
| 6,834,471 | B2 | | 12/2004 | Takagi et al. | |
| 7,051,988 | B2 | * | 5/2006 | Shaw et al. | 249/219.1 |
| 2002/0073634 | A1 | | 6/2002 | Bolinger et al. | |
| 2002/0145093 | A1 | | 10/2002 | Shaw et al. | |

FOREIGN PATENT DOCUMENTS

| | | |
|---|---|---|
| DE | 3430564 | 3/1986 |
| DE | 3503810 | 8/1986 |
| EP | 0639686 | 2/1995 |
| JP | 6-129043 | 5/1994 |
| JP | 10246212 | 9/1998 |
| WO | WO 02/43534 | 6/2002 |

OTHER PUBLICATIONS

Berreth Rainer Dipl Ing (DE), *English Abstract of Angular Shuttering Element for Floors*, Patent No. DE3430564, esp@cenet database, Published Mar. 6, 1986 (1 page).

Reymann Wolfgang (DE), *English Abstract of Shuttering-System for Concrete Elements*, Patent No. EP0639686, esp@cenet database, Published Feb. 22, 1995 (1 page).

White Cap Industries, *Panel-Trak Forming System*, www.whitecapdirect.com, Nov. 14, 2001 (4 pages).

* cited by examiner

CONCRETE FORM BRACE AND BATTERING WEDGE

This application is related to application Ser. No. 10/121,125, filed Apr. 11, 2002 (pending) and application Ser. No. 10/425,519, filed Apr. 29, 2003 (pending).

FIELD OF THE INVENTION

This invention pertains generally to concrete construction, and more particularly to a brace for securing concrete forms to a casting surface.

BACKGROUND OF THE INVENTION

Concrete wall panels are conventionally used in the construction of industrial buildings and other structures. In general, individual concrete wall panels are formed at the construction site by pouring concrete into forms which have been assembled on a casting surface, such as the floor of the building where the wall panels will be used. The concrete forms are typically secured to the casting surface by braces which hold the forms in place until the concrete wall panel has cured. The concrete forms are typically made of wood and the braces are often nailed to the forms and the casting surface. When the wall panel has cured, the nails and braces are removed from the forms and the casting surface, and the concrete panel is then raised to a desired position. Thereafter, the forms may be reused to cast another concrete wall panel.

In some applications, the forms defining a top edge of the wall panel may be tilted, or battered, to create a sloping surface in the formed wall when the wall is raised to a vertical orientation. Advantageously, the sloped surface facilitates directing rainwater toward a roof surface of the building of which the wall is a part, rather than permitting rainwater to otherwise run down the exterior sides of the wall.

Prior braces for securing concrete forms include wooden blocks and steel braces. The wooden blocks are typically saw cut into a triangular shape and are not always dimensionally uniform. These wooden blocks are usually damaged upon removal from the concrete forms and are therefore generally not reusable. Prior steel braces are generally reusable, but are also generally more expensive than wooden blocks, and considerably heavier, rendering them less convenient to transport and handle.

There is thus a need for a brace which can be used to secure concrete forms at a work site and which overcomes drawbacks of the prior art, such as those described above.

SUMMARY OF THE INVENTION

The present invention provides a concrete form brace which is convenient for use in securing concrete forms in an upstanding orientation relative to a concrete casting surface. In an exemplary embodiment, the form brace has a pair of confronting sidewalls, each having a generally triangular shape. Two side edges of the sidewalls are disposed at approximately 90 degrees to one another, and a back wall extends between the sidewalls, opposite the 90 degree angle. Ribs extending between the sidewalls help to reinforce the sidewalls and add rigidity to the brace. A flange extends outwardly from the side edges of the sidewalls and the ends of the back wall, around the periphery of the brace. Apertures formed through the peripheral flange are sized to receive fasteners, such as nails, to facilitate securing the brace to the form and the casting surface. In one embodiment, the brace is formed as a unitary, molded component.

In another embodiment, a battering wedge is selectively couplable to the side edges of the brace, whereby the battering wedge cooperates with the brace to facilitate tilting a concrete form with respect to the casting surface. Apertures are formed through the battering wedge which correspond with the apertures formed in the peripheral flange of the brace, to facilitate fastening the brace and battering wedge to the form and the casting surface. The battering wedge is selectively frangible to size the battering wedge for use with form braces of varying dimensions.

In another embodiment, an assembly for forming concrete structures includes a casting surface, a concrete form, and a form brace as described above.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
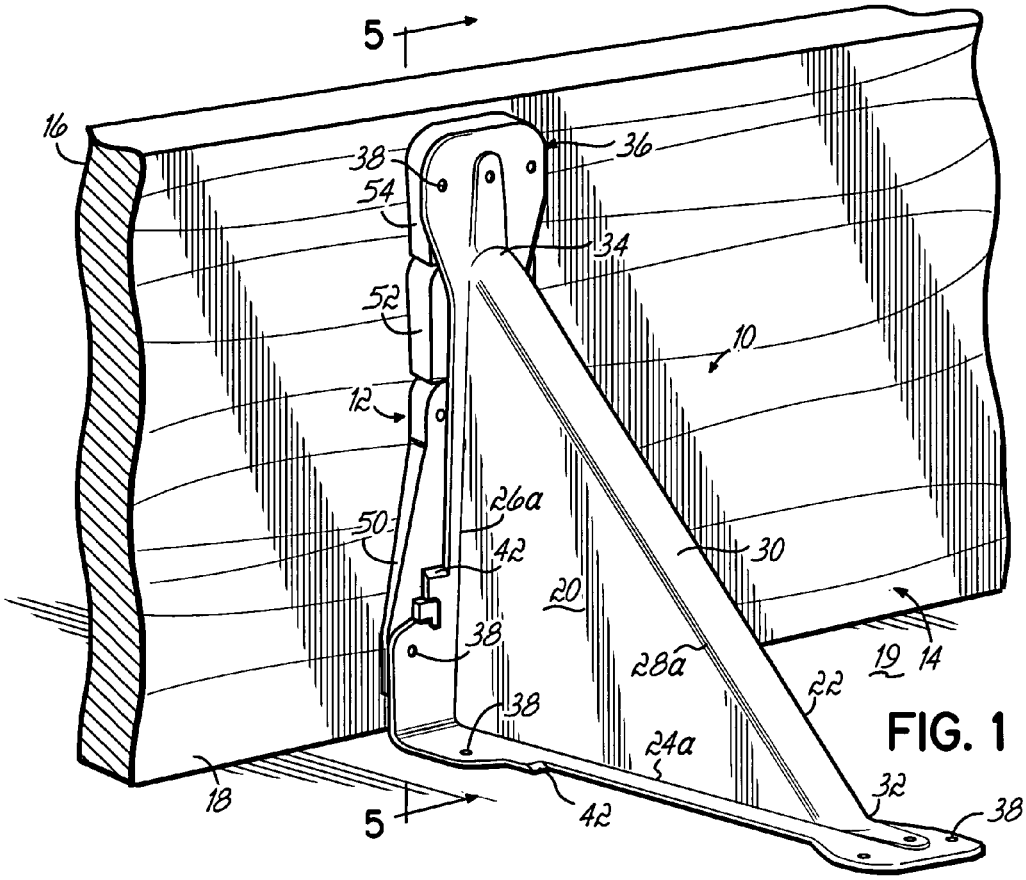
FIG. 1 is a perspective view depicting an exemplary brace and battering wedge according to the present invention.

In FIG. 1, there is shown an exemplary brace 10 and battering wedge 12 according to the present invention, for supporting a concrete form member 14 in an upstanding relation to a concrete casting surface 19. The brace 10 includes first and second confronting sidewalls 20, 22 each having a generally triangular shape. First and second adjacent side edges 24*a*, 26*a* and 24*b*, 26*b* of the respective sidewalls 20, 22 are positioned to form an included angle of approximately 90 degrees. While second sidewall 22 and second side edges 24*b*, 26*b* are not visible in FIG. 1, these features are shown in FIG. 4 for a corresponding brace 10*b*.

A third side edge 28*a*, 28*b* of the respective sidewalls 20, 22 is disposed opposite the angle between the first and second side edges 24*a*, 24*b*, 26*a*, 26*b*. The brace 10 further includes a backwall 30 extending between the third side edges 28*a*, 28*b* of the first and second sidewalls 20, 22. The backwall 20 has a first end 32 proximate the first side edges 24*a*, 24*b* of the first and second sidewalls 20, 22 and a second end 34 proximate the second side edges 26*a*, 26*b*.

Figure 2:
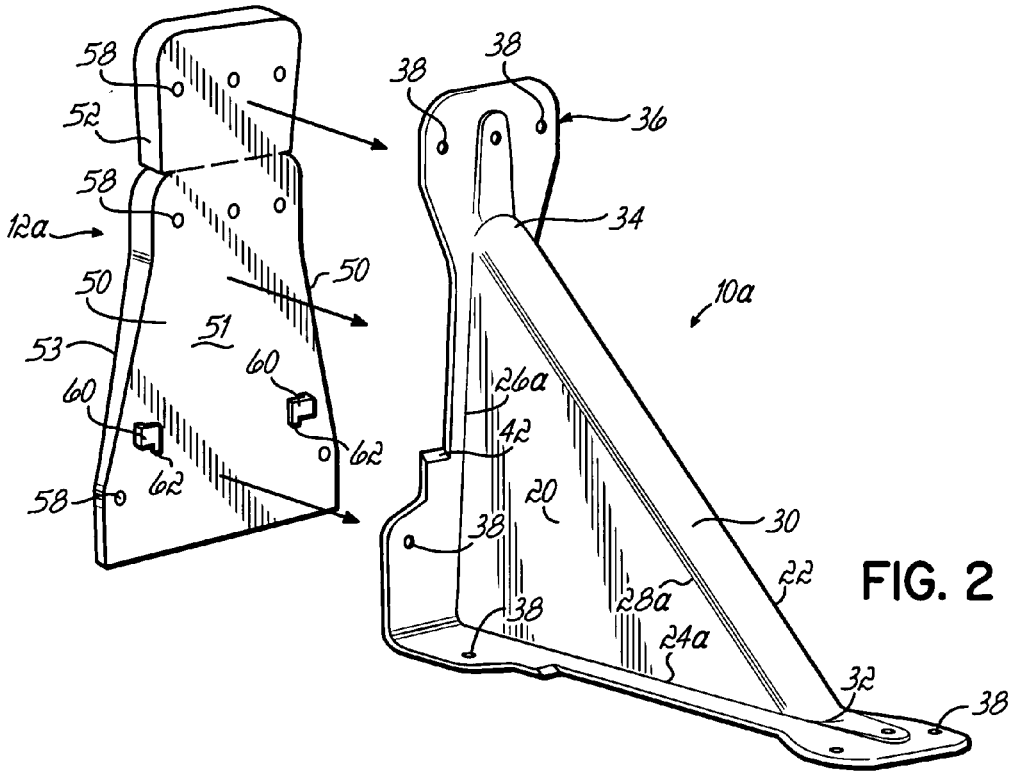
FIG. 2 is a perspective view depicting another embodiment of a brace and battering wedge, similar to FIG. 1.
Figure 3:
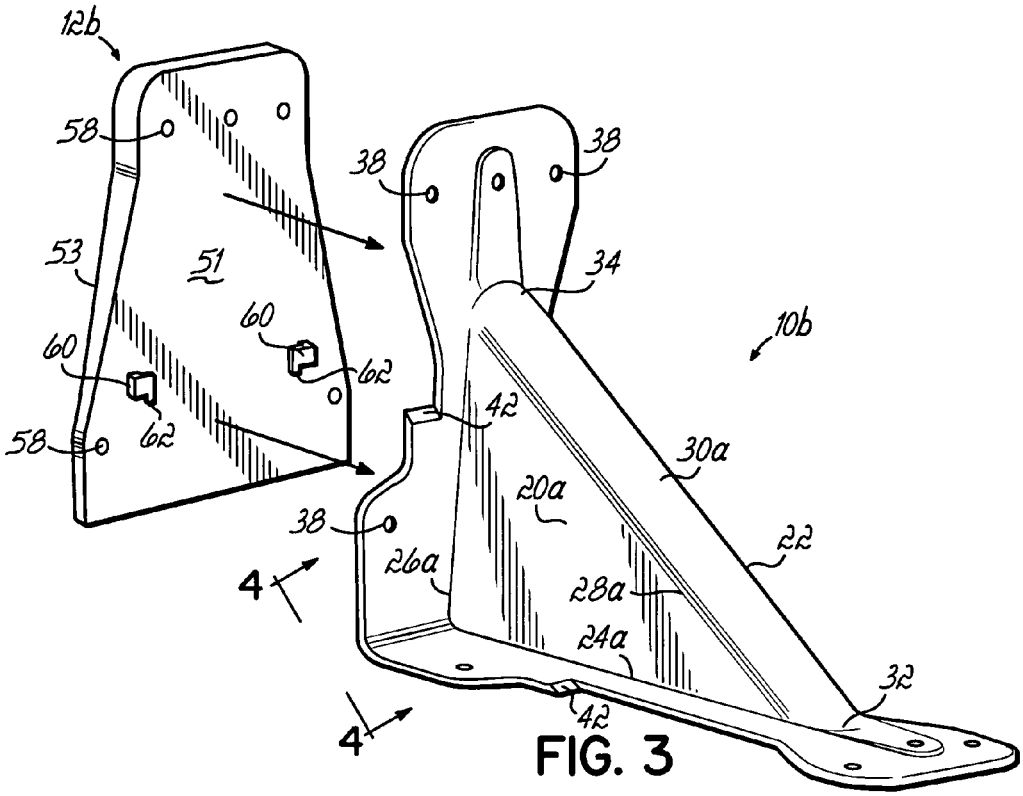
FIG. 3 is a perspective view depicting yet another embodiment of a brace and battering wedge according to the present invention.
Figure 4:
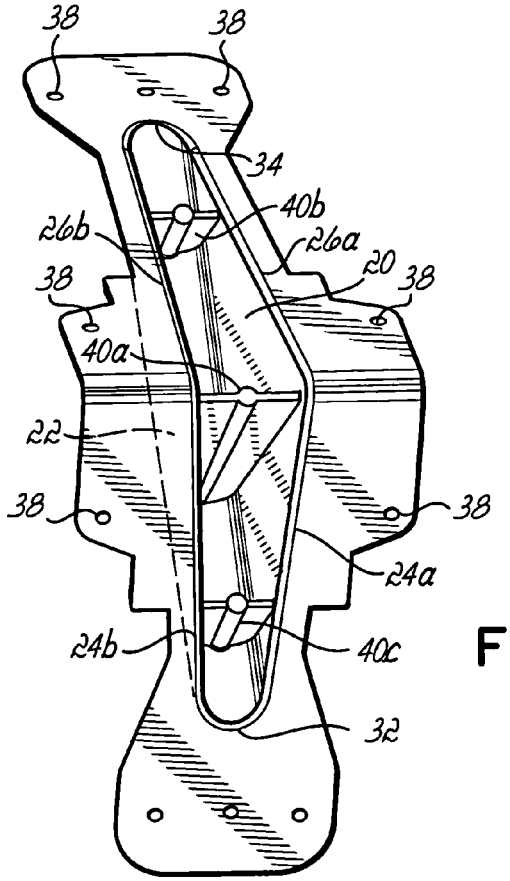
FIG. 4 is a perspective view of the brace of FIG. 3, as viewed along lines 4-4 of FIG. 3.

FIGS. 2-4 depict additional embodiments of form brace 10*a*, 10*b*, similar to brace 10 shown in FIG. 1, as will be described in more detail below. In these figures, like features have been similarly numbered. As best seen in FIG. 4, elongate webs 40*a*, 40*b*, 40*c* extend between the confronting side surfaces of the first and second sidewalls 20, 22. In the embodiment depicted in FIG. 4, the ribs 40*a*, 40*b*, 40*c* extend perpendicularly from the backwall 30 in a direction toward the first and second side edges 24*a*, 24*b*, 26*a*, 26*b* of the first and second sidewalls 20, 22.

The brace 10 further includes a flange portion 36 generally surrounding and extending outwardly from a periphery defined by the first and second side edges 24*a*, 24*b*, 26*a*, 26*b* of the sidewalls 20, 22 and the first and second ends 32, 34 of the backwall 30. Advantageously, enlarged areas of the flange portion 36 adjacent the intersection of the first and second side edges 24*a*, 24*b*, 26*a*, 26*b* of the first and second sidewalls 20, 22 and the ends 32, 34 of the backwall 30 facilitate securing the brace 10 to the casting surface 19 and the form member 14 which is supported by the brace 10. In the embodiment shown, these areas of the flange portion 36 are provided with holes 38 for receiving fasteners therethrough to secure the brace 10 as is known in the art. The flange portion 36 may further comprise laterally outwardly extending ears 42 disposed on opposite sides of the sidewalls 20, 22 for securing the battering wedge 12 to the brace 10, as will be described more fully below.

Figure 5:
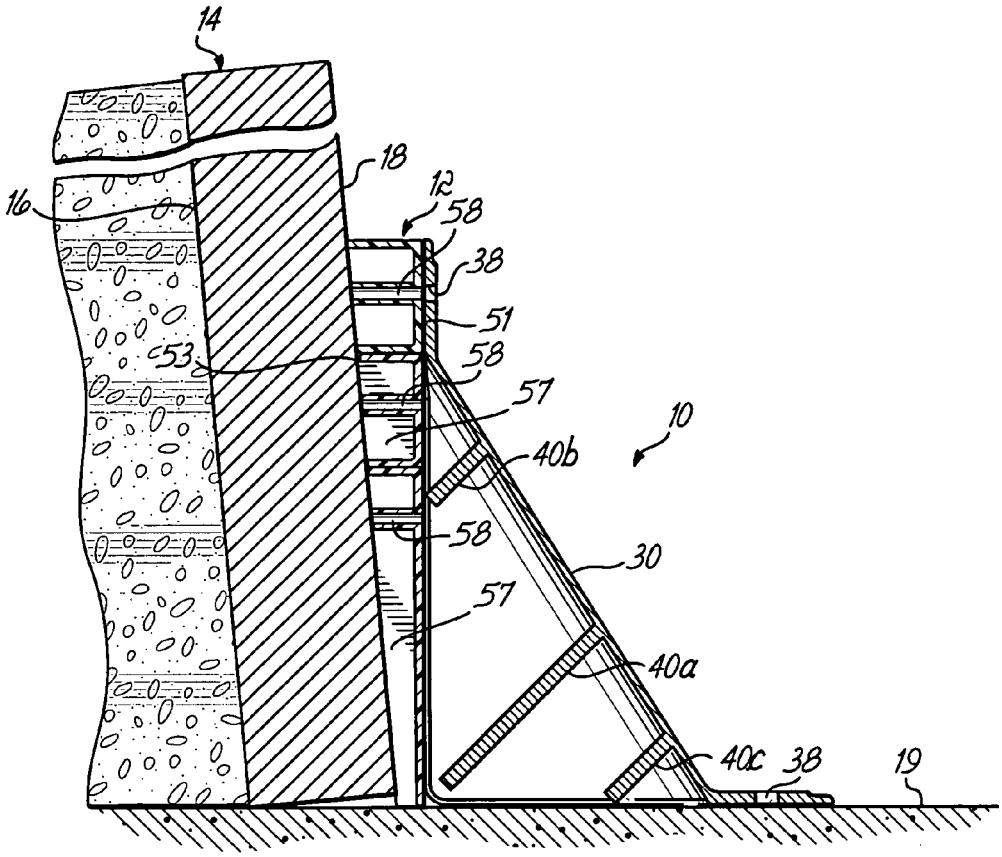
FIG. 5 is a cross-sectional view of the brace and battering wedge of FIG. 1, taken along lines 5-5 of FIG. 1.
Figure 6:
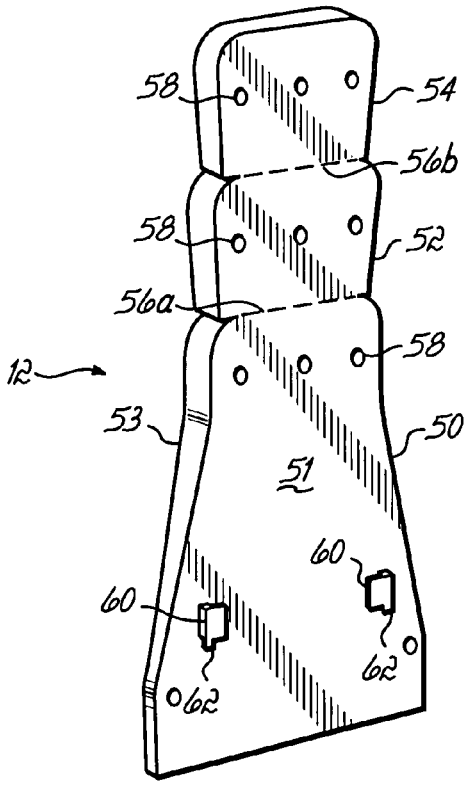
FIG. 6 is a perspective view of the battering wedge of FIG. 1.

The brace 10 may be used to secure a concrete forming member 14 in an upstanding relationship with respect to a concrete casting surface 19. The brace 10 may either be used alone, to secure the forming member 14 in a substantially vertical orientation, or the brace 10 may be used in conjunction with a battering wedge 12 to tilt the forming member 14, as is known in the art. Referring to FIGS. 5 and 6, the battering wedge 12 may be removably attached to brace 10 to secure a concrete forming member 14 in a tilted position, as described above. The battering wedge 12 has a first side 51 configured to abut the flange portion 36 of the brace 10, and a second side 53 angularly spaced from the first side 51 for engaging the concrete forming member 14.

The battering wedge 12 may have a substantially solid construction or may have voids 57 formed in the second side 53, as best depicted in FIG. 5. To facilitate securing the battering wedge 12 to the brace 10, a pair of laterally disposed tabs 60 having resilient finger portions 62 are provided on the first side 51 of the battering wedge 12. Advantageously, the tabs 60 positively engage the outwardly extending ears 42 of the flange portion 36 and bracket the brace 10 to thereby secure the battering wedge 12 adjacent either the first or second side edges 24*a*, 24*b*, 26*a*, 26*b* of the brace 10.

Advantageously, the first and second side edges 24*a*, 24*b* and 26*a*, 26*b* of the brace 10 are formed with different lengths, each corresponding to a selected size form member 14, whereby the brace 10 may be utilized with different size form members 14 by simply orienting the brace 10 to engage either the first or second side edges 24*a*, 24*b* or 26*a*, 26*b* with the form member 14.

With continued reference to FIG. 6, battering wedge 12 includes first, second, and third separable sections 50, 52, 54 which may be selectively separated from the battering wedge 12 along lines 56*a* and 56*b* to thereby conform the battering wedge 12 to a particular size of first or second side edges 24*a*, 24*b* and 26*a*, 26*b* of the brace 10.

FIGS. 2 and 3 depict additional exemplary embodiments of the brace 10*a*, 10*b* each sized to mate with a concrete forming member 14 of a different size. These figures also depict battering wedges 12*a*, 12*b* which have been formed from the battering wedge 12 depicted in FIG. 6 by selectively separating the second and third sections 52, 54 such that the battering wedges 12*a*, 12*b* correspond to the respective form braces 10*a*, 10*b*. Battering wedge 12 further includes holes or apertures 58 formed through the first and second sides 51, 53 for receiving fasteners therethrough to facilitate securing the braces 10 and battering wedges 12 to the form members 14 or casting surface 19. Advantageously, the locations of the apertures 58 in the battering wedge 12 correspond to the locations of the apertures 38 formed in the flange portions 36 of the braces 10, 10*a*, 10*b*.

While FIG. 5 depicts an arrangement wherein battering wedge 12 is secured to brace 10 adjacent the second side edges 26*a*, 26*b*, it will be recognized that battering wedge 12 may alternatively be secured to the first side edges 24*a*, 24*b* of the brace 10 such that second side edges 26*a*, 26*b* engage casting surface 19 to tilt forming member 14 in a similar manner.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A brace for securing concrete forms to a base, comprising:

first and second confronting sidewalls, each sidewall having a generally triangular shape, first and second adjacent side edges defining an included angle of approximately 90 degrees therebetween, and a third side edge disposed opposite said angle between said first and second side edges;

a back wall extending between said third side edges of said first and second sidewalls, said back wall having a first end proximate said first side edges of said sidewalls and a second end proximate said second side edges of said sidewalls;

said first and second confronting sidewalls and said back wall defining a generally empty cavity substantially enclosing at least one rib extending between said first and second sidewalls, wherein said brace is principally hollow; and a flange portion extending outwardly from a periphery defined by said first and second side edges of said sidewalls and said first and second ends of said back wall, said flange portion including enlarged areas extending further outwardly from the intersections of said side edges and said ends of said back wall, said enlarged areas including at least one aperture for receiving a fastener therein.

2. The brace of claim 1, wherein said rib is elongated and directed substantially perpendicular to said back wall.

3. The brace of claim 1, further comprising a battering wedge selectively attachable proximate one of said first and second side edges of said sidewalls to tilt a concrete forming member at an obtuse angle with respect to the other of said first and second side edges of said sidewalls.

4. The brace of claim 3, wherein said battering wedge comprises a first side configured to abut said flange portion of said brace, a second side configured to engage a concrete forming member, and a tapered profile extending between said first and second sides for tilting said concrete forming member with respect to the abutted flange portion of said brace.

5. The brace of claim 4, wherein said battering wedge further comprises tabs formed on said first side and spaced to engage said flange portion adjacent said first and second sidewalls, said tabs including resilient fingers configured to engage said flange portion.

6. The brace of claim 3, wherein said battering wedge includes at least one separable section that is selectively frangible along a pre-formed boundary from a remainder of said battering wedge so as to conform said remainder to said flange portion proximate one of said first and second side edges of said sidewalls.

7. The brace of claim 1 formed as a unitary, molded piece.

8. The brace of claim 4, wherein said battering wedge includes voids formed in said second side.

9. The brace of claim 3, wherein said battering wedge includes at least two pre-formed sections joined along adjoining sides and selectively separable along said adjoining sides, with at least one of said pre-formed sections being sized so as to correspond to the size of one of said first and second side edges of said sidewalls.

10. The brace of claim 3, wherein said battering wedge includes at least two sections selectively separable across a pre-formed joint.

11. An assembly for forming concrete structures, comprising:

a casting surface;

a form member disposed on said casting surface to define a space for receiving poured, wet concrete, said form member having first side adapted to contact the concrete and a second side opposite said first side; and a brace comprising:

first and second confronting sidewalls, each sidewall having a generally triangular shape with first and second adjacent side edges spaced to form an included angle of approximately 90 degrees therebetween and a third side edge disposed opposite said angle between said first and second side edges, a back wall extending between said third side edges of said first and second sidewalls, said back wall having a first end proximate said first side edges of said sidewalls, and a second end proximate said second side edges of said sidewalls, at least one rib extending between confronting side surfaces of said first and second sidewalls, and a flange portion extending outwardly from a periphery defined by said first and second side edges of said sidewalls and said first and second ends of said back wall;

said brace coupled to said second side of said form member by said flange portion adjacent one of said first and second side edges, and coupled to said casting surface by said flange portion adjacent the other of said first and second side edges.

12. The assembly of claim 11, further comprising a battering wedge disposed between said brace and said form member to thereby tilt said form member relative to said casting surface.

* * * * *